United States Patent [19]

Hiyamizu et al.

[11] Patent Number: 4,906,011

[45] Date of Patent: Mar. 6, 1990

[54] VACUUM CHUCK

[75] Inventors: Makoto Hiyamizu, Saitama; Kazuhiro Nagashima, Tochigi; Yasuhiro Tani, Tokyo, all of Japan

[73] Assignee: Nikko Rica Corporation, Tokyo, Japan

[21] Appl. No.: 290,462

[22] Filed: Dec. 27, 1988

[30] Foreign Application Priority Data

Feb. 26, 1987 [JP] Japan ..... 62-41280

[51] Int. Cl.[4] ..... B25B 11/00

[52] U.S. Cl. ..... 279/3; 269/21

[58] Field of Search ..... 269/21; 279/3

[56] References Cited

U.S. PATENT DOCUMENTS 4,521,995 6/1985 Sekiya ..... 269/21 X

FOREIGN PATENT DOCUMENTS 147094 7/1985 European Pat. Off. ..... 269/21

141444 7/1985 Japan ..... 269/21

*Primary Examiner*—Steven C. Bishop

*Attorney, Agent, or Firm*—McAulay Fisher Nissen & Goldberg

[57] ABSTRACT

The vacuum chuck, which is an accessory device for holding a workpiece in machining and inspection, has a suction head made of a porous sintered particles of a thermoplastic resin, e.g., a fluorocarbon resin, preferably, bonded to the chuck base. The suction head is free from the problem of unreliableness of holding of workpieces without the danger of damaging the workpiece. The outer peripheral surfaces of the sucking head are provided with an air-impermeable layer to increase the efficiency of suction by preventing leakage of vacuum. The water-and-oil-resistance of the suction head can be improved by blending the powder of the thermoplastic resin with a powder of a thermosetting resin, e.g., epoxy resin.

19 Claims, 1 Drawing Sheet

VACUUM CHUCK

BACKGROUND OF THE INVENTION

The present invention relates to a vacuum chuck which is an attachment for holding a workpiece or tool in conducting machining or measurement utilizing a power of suction by means of a negative pressure of vacuum. More particularly, the invention relates to a vacuum chuck of which the suction head is formed of a unique material.

Conventional chucks for holding a workpiece or tool in machining or inspection include mechanical chucks, electromagnetic chucks, vacuum chucks and the like, of which vacuum chucks are used for holding a workpiece having a relatively small thickness and made of a non-magnetic material such as an aluminum-made disc for magnetic recording media, glass plate for photomasks, single crystal wafers of, for example, semiconductor silicon and the like.

A typical suction head in a conventional vacuum chuck has vacuum ducts in the form of perforations or in the form of grooved channels connected together including perforations. When the vacuum ducts are provided with perforations alone, the cross sectional area available for suction is so limited that the holding power of the workpiece is necessarily insufficient. When the vacuum ducts are formed of grooved channels, the pressure by which the workpiece is pressed against the suction head differs widely between the portion in direct contact with the groove and the portion not in direct contact with the groove so that the workpiece is more or less deformed to cause a problem in the accuracy of machining or inspection when an extremely high accuracy is desired.

With an object to solve these problems, it is proposed to use a sintered porous body of a metal or ceramic as a material of the suction head which serves to suck and attract the workpiece over the whole surface. A serious problem in these suction heads of a sintered porous metal or ceramic body is that, since metals and ceramics generally have a high hardness, workpieces made of a soft material such as aluminum are liable to be damaged by contacting with such a hard suction head of the vacuum chuck in the course of suction, holding and releasing. Moreover, self-excited vibration of the suction head sometimes takes place in working due to the high holding rigidity and low damping power against vibration to cause a difficulty in high-precision machining.

In this regard, conventional vacuum chucks for a workpiece of a soft metal are usually provided with a suction head made of a plastic and having grooved channels as the vacuum ducts. Such a plastic-made suction head is of course defective as is mentioned above because the workpiece attracted to the head is machined only insufficiently at the portions just above the grooves as a consequence of low rigidity leading to a poor accuracy of the flatness and shape after completion of the machining work.

SUMMARY OF THE INVENTION

The present invention accordingly has an object to provide a novel and improved vacuum chuck free from the above described problems and disadvantages in the conventional vacuum chucks and suitable for machining of a workpiece made of a relatively soft material to ensure extremely high precision and accuracy.

Thus, the vacuum chuck of the invention comprises a suction head formed of a porous body of sintered particles of a plastic resin having open pores which serve as the vacuum ducts.

DETAILED DESCRIPTION OF THE PREFERRED EMBODIMENTS

Figure 1:
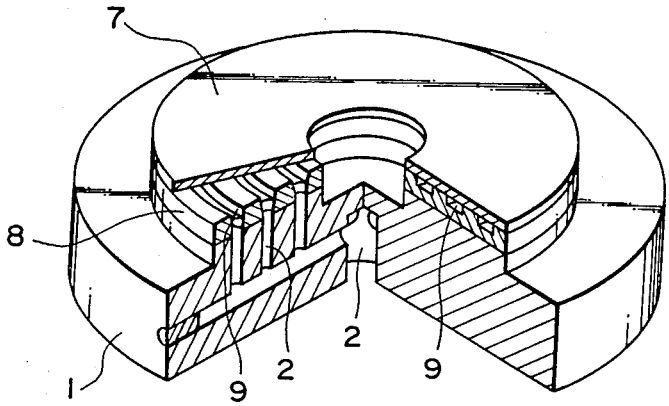
FIG. 1 PRIOR ART
FIG. 1 is a perspective view of a conventional vacuum chuck having grooved channels as the vacuum ducts as partly cut and a workpiece held thereby.

FIG. 1 illustrates a conventional vacuum chuck as partly cut by a perspective view. In FIG. 1, an annular suction head 8 made of a rigid and non-porous plastic resin is provided with grooved channels 9 running concentrically and mounted on and adhesively bonded to the metal-made chuck base 1 of the vacuum chuck. The grooved channels 9 are communicated to the perforations 2 in the chuck base 1 to form vacuum ducts so that the workpiece 7 mounted on the suction head 8 is strongly pressed against the suction head 8 when the vacuum ducts of the vacuum chuck are connected to a vacuum line (not shown in the figure).

Figure 2:
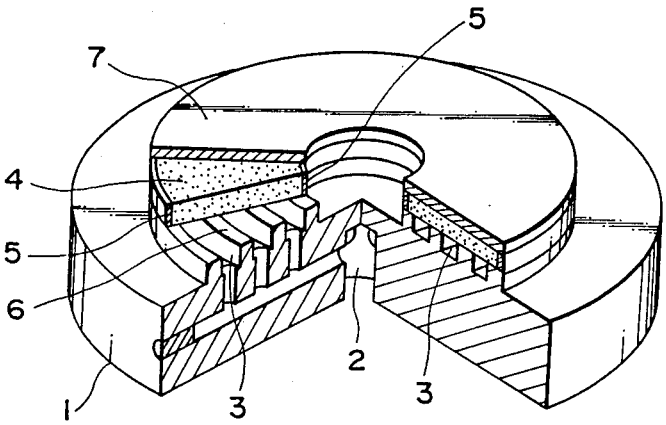
FIG. 2 is a perspective view of a vacuum chuck according to the invention having a porous sintered plastic body as the suction head as partly cut and a workpiece held thereby.

FIG. 2, on the other hand, illustrates a vacuum chuck of the invention as partly cut by a perspective view. As is shown in this figure, the annular suction head 4 is made of a porous body which is prepared by sintering fine particles of a thermoplastic resin and the inner and outer peripheral surfaces thereof are provided with air-impermeable layers 5,5. The suction head 4 is mounted on and adhesively bonded to the upper surface 6 of a metal-made chuck base 1.

The suction head 4 made of a porous sintered plastic powder can be prepared according to a known procedure in which a powder of a thermoplastic resin is shaped by molding in a metal mold without heating and then the power compact is heated at an appropriate temperature to effect sintering of the plastic particles. It is important in the invention that the process of sintering is performed under such conditions that open pores are formed to serve as the vacuum ducts.

Examples of suitable thermoplastic resins include, for example, fluorocarbon resins, polyamide resins, polyethylenes, polystyrenes, polyvinyl chloride resins, polyvinyl alcohols, polycarbonate resins, acrylic resins and the like which can be selected and used without particular limitations depending on the hardness of the workpieces, strength of suction by vacuum, method of machining and so on. These plastic resins can be used either singly or as a blend of two kinds or more according to need.

When the suction head 4 shaped of a thermoplastic resin powder has somewhat poor water-resistance and oil-resistance, the deficiency can be remedied by undertaking a following method. Thus, the powder of the thermoplastic resin before shaping and sintering is admixed with a minor amount of a powder of a thermosetting resin such as an epoxy resin, phenol-formaldehyde resin, melamine resin, furan resin, polyurethane resin, urea resin, unsaturated polyester resin, silicone resin and the like or a powder of a soft metal such as copper, tin, lead and the like or an oxide thereof and the suction head 4 is prepared by shaping and sintering such a powder blend. In this way, the suction head 4 is imparted with improved water-resistance and oil-resistance and can be used even in machining works under a wet condition. The amount of the thermosetting resin added to the thermoplastic resin powder is preferably in the range from 3 to 30% by weight of the thermoplastic resin powder.

The suction head 4 made of a sintered body of a thermoplastic resin having open pores illustrated in FIG. 2 has another advantage over the conventional suction head 8 made of a nonporous plastic resin illustrated in FIG. 1. Namely, it is a problem common in an article shaped of a thermoplastic resin having good water resistance and oil resistance that a difficulty is usually encountered in adhesively bonding such a plastic-made article having poor adhesive receptivity, for example, to the surface of a metal-made body as in the adhesive bonding of the plastic-made suction head 8 to the metal-made chuck base 1 illustrated in FIG. 1. In contrast thereto, a porous body of a thermoplastic resin having open pores is fully receptive of an adhesive because of the anchoring effect exhibited by the adhesive infiltrating into the open pores of the sintered plastic body. The depth of infiltration of the adhesive into the pores can be controlled by adequately selecting various parameters including the type and viscosity of the adhesive, type of the thermoplastic resin and porosity and pore diameter of the sintered body. The porous sintered body as the suction head 4 should have a porosity in the range from 10 to 70%. When the porosity is smaller than 10%, the air permeability of the porous body is poor to exhibit a great resistance against suction. When the porosity is larger than 70%, the porous body may have a decreased mechanical strength. The pore diameter can be in a wide range from 1 to 1000 μm but preferably the pore diameter should be in the range from 3 to 500 82 um.

It should be noted here that a possible drawback taking place in the above described suction head 4 made of an open-pore sintered plastic resin is leakage of vacuum because the open pores are communicated in all directions. When an annular suction head 4 illustrated in FIG. 2 is used with the inner and outer peripheries unprotected for holding a thin workpiece 7, which may be an aluminum disc for magnetic recording media, leakage of vacuum occurrs on the peripheral surfaces open to the atmosphere to cause a decrease in the efficiency of suction of the vacuum chuck so that the accuracy of machining using the vacuum chuck may be decreased. Accordingly, it is important that the peripheral surfaces of the suction head 4 are protected from leakage of vacuum by providing protecting layers 5 impermeable to air. Such an air-impermeable protecting layer 5 can be formed in various ways. For example, firstly, the peripheral surface is coated with a melt of a thermoplastic resin by casting or injection molding. The thermoplastic resin of the melt can be the same kind as the plastic resin forming the porous plastic-made suction head 4 though not limited thereto. Any thermoplastic resin can be used for the purpose provided that the resin has softening and melting characteristics not to cause softening of the porous sintered body of the suction head 4 in the course of casting or injection molding. Secondly, an air-impermeable layer 5 can be formed by merely coating the peripheral surfaces with an adhesive. Thirdly, the peripheral portion of the suction head 4 of the porous sintered body is locally heated, for example, by contacting with a hot welding tool to cause local softening and melting of the body so that the pores are closed to form an air-impermeable protecting layer 5. These methods can be undertaken appropriately in consideration of the kind of the thermoplastic resin forming the porous suction head and the intended application of the vacuum chuck of the invention. The thickness of the air-impermeable protecting layer 5 of course depends on the intended application of the vacuum chuck. For example, the thickness should not exceed 2 mm when the vacuum chuck is used for machining of aluminum-made discs.

The vacuum chuck of the invention can be used in machining of workpieces made of a variety of materials having a hardness equal to or higher than the hardness of the thermoplastic resin forming the suction head including plastics, metals having a relatively low hardness such as aluminum, copper and the like, iron or steel, glass, single crystal wafers of semiconductors such as silicon and gallium arsenide, ceramic materials such as silicon carbide, alumina and the like, and so on. The workpiece should desirably have a large surface area available for suction and a small thickness but use of an appropriate adapter may facilitate working with a workpiece not so wide in surface area and not so small in thickness by expanding the effective surface area available for suction.

In the following, examples are given to illustrate the vacuum chuck of the invention in more detail.

EXAMPLE 1

A metal mold of an annular form was filled with 33 g of a powder of a poly(tetrafluoroethylene) resin having an average particle diameter of 104 μm and the powder was pressed at room temperature by applying a pressure of 80 kg/cm$^2$. The powder compact was then heated in air at 360° C. for 3 hours to give an annular sintered disc having a thickness of 3 mm, outer diameter of 94 mm and inner diameter of 26 mm. The sintered body had a porosity of 21.1%, Young's modulus of 44 kg/mm$^2$ and hardness of 34 to 36 in Shore D.

The outer and inner peripheral surfaces of the annular sintered body 4 were contacted for 3 seconds with a stainless steelmade welding tool heated at 400° C. under a pressure of 30 kg/cm$^2$ so that the peripheral layers of the sintered body were softened and melted and the open pores there were closed to form air-impermeable protecting layers 5 illustrated in FIG. 2. The thus formed air-impermeable protecting layers had a thickness of 0.2 to 0.3 mm.

The surface 6 of the chuck base 1 made of an aluminum alloy between the grooves 3 were coated with a synthetic rubber-based adhesive and the suction head 4 above prepared was adhesively bonded thereto to form a vacuum chuck, which was mounted on an ultra high-precision lathe having a vacuum line built therein (not shown in the figure). The suction surface of the suction head 4 was finished by latching with an extra high precision.

The thus prepared vacuum chuck was used for high-precision lathing of aluminum discs of 3.5 inches diameter for magnetic recording media as held by the suction head 4 using a 2 mm-wide flat cutting tool of single crystalline diamond under a spray of white kerosene as a cutting oil. The machining conditions included 3600 rpm of the velocity of revolution, 10 μm per revolution of feed, 10 μm of infeed and 360 Torr of the pressure of the vacuum line. The results in the finishing of 30,000 aluminum discs were 0.3 to 0.7 μm of the out-of-straightness and 0.02 to 0.04 μm/3 mm of the microscopic undulation on the outer periphery. The yield of acceptably finished workpieces in this test was 99.5% which was a much higher value than 75% obtained by using a conventional vacuum chuck due to the unacceptably large microscopic undulation on the outer periphery. These results well support the conclusion that the inventive vacuum chuck is quite satisfactory in industrial machining works for mass production.

EXAMPLE 2

A metal mold of an annular form was filled with 29 g of a powder of a poly(trifluoro chloro ethylene) resin having an average particle diameter of 15 μm and the powder was pressed at room temperature by applying a pressure of 80 kg/cm$^2$. The powder compact was then heated in air at 260° C. for 3 hours to give an annular sintered disc having a thickness of 3 mm, outer diameter of 94 mm and inner diameter of 26 mm. The sintered body had a porosity of 29.5%, Young's modulus of 60 kg/mm$^2$ and hardness of 64 to 66 in Shore D.

With an object to form air-impermeable protecting layers with the open pores closed in the outer and inner peripheries of the above obtained annular disc, outsert injection molding of the same poly(trifluoro chloro ethylene) resin as above was performed using an injection molding machine in a conventional manner. The injected resin on the peripheral surfaces was found to have infiltrated to a depth of 0.15 to 0.20 mm under the pressure of injection. The thus injection-molded portion was subsequently lathed so that the air-impermeable layers after finishing had a thickness of 0.2 mm.

The thus prepared suction head was used in a test machining of aluminum discs in the same manner as in Example 1. The results in the finishing of 30,000 aluminum discs were 0.4 to 0.8 μm of the out-of-straightness and 0.02 to 0.05 μm/3 mm of the microscopic undulation on the outer periphery.

EXAMPLE 3

A metal mold of an annular form was filled with 16 g of a powdery blend composed of a powder of 66-nylon resin having an average particle diameter of 74 μm and a powder of an epoxy resin having an average particle diameter of 1 μm in a weight ratio of 19:1. The powder blend was pressed at room temperature by applying a pressure of 200 kg/cm$^2$. The powder compact was then heated in a non-oxidizing atmosphere at 250° C. for 3 hours to give an annular sintered disc having a thickness of 3 mm, outer diameter of 94 mm and inner diameter of 26 mm. The sintered body had a porosity of 25.0%, Young's modulus of 170 kg/mm$^2$ and hardness of 76 to 77 in Shore D.

With an object to form air-impermeable layers on the outer and inner peripheral surfaces, the surfaces were coated with an epoxy adhesive. The thus formed air-impermeable protecting layers had a thickness of 0.04 to 0.06 mm after curing of the epoxy adhesive but it was found by inspecting the cross section that the adhesive resin infiltrated to a depth of 0.03 to 0.04 mm into the open pores so that the air-impermeability of the protecting layers was complete.

The surface 6 of the chuck base 1 made of an aluminum alloy between the grooves 3 were coated with an epoxy resin-based adhesive and the suction head 4 above prepared was adhesively bonded thereto to give a vacuum chuck which was used in a test machining of aluminum discs in the same manner as in Example 1. The results in the finishing of 30,000 aluminum discs were 1.0 to 2.2 μm of the out-of-straightness and 0.04 to 0.06 μm/3 mm of the microscopic undulation on the outer periphery. Although no improvement can be obtained in the out-of-straightness, a substantial improvement could be obtained in the microscopic undulation on the outer periphery as compared with the results obtained in the comparative test described below to indicate the effectiveness of the whole-surface suction in the inventive vacuum chuck. The mechanical strength of the suction head of the porous epoxy resin was so excellent that the head had a durability to be serviceable for the machining works of 100,000 or even more of aluminum discs of 3.5 inches diameter.

Comparative Example

A block of a rigid polyurethane resin for a suction head in a vacuum chuck was prepared by casting a curable resin composition, which was prepared from 50 g of a polyester prepolymer kept at 85° C. with admixture of 6.35 g of methylene bis(2-chloroaniline) molten at 120° C. followed by thorough mixing and deaeration, into a frame around the chuck base 1 illustrated in FIG. 1 and heating the resin composition at 120° C. for 5 hours. The thus obtained rigid polyurethane resin block had a Young's modulus of 1.7 kg/mm$^2$ and hardness of 41 to 43 in Shore D. The cured polyurethane resin entering the perforations 2 of the chuck base 1 was removed by machining and groove-like channels 9 were formed by lathing on the surface of the rigid polyurethane block on the chuck base 1 so that a vacuum chuck was obtained with the suction head 8 bonded to the chuck base 1. The adhesive bonding was complete between the suction head 8 and the chuck base 1.

The thus prepared vacuum chuck was used in a test machining of aluminum discs in the same manner as in Example 1. The results in the finishing of about 20,000 aluminum discs were 0.8 to 2.1 μm of the out-of-straightness and 0.05 to 0.22 μm/3 mm of the microscopic undulation on the outer periphery. The test machining was discontinued after finishing of about 20,000 aluminum discs because of the rapid increase in the out-of-straightness which exceeded 3 μm presumably due to the exfoliation of the suction head 8 from the chuck base 1 though in a very slight extent.

What is claimed is:

1. A vacuum chuck which comprises a chuck base and a suction head formed of a porous body of sintered particles of a thermoplastic resin having open pores which serve as the vacuum ducts.

2. The vacuum chuck as claimed in claim 1 wherein the porous body is a sintered powder blend composed of particles of a thermoplastic resin and particles of a thermosetting resin.

3. The vacuum chuck as claimed in claim 1 wherien the thermoplastic resin is a fluorocarbon resin.

4. The vacuum chuck as claimed in claim 1 wherein the thermoplastic resin is a polyamide resin.

5. The vacuum chuck as claimed in claim 1 wherein the chuck base and the suction head are adhesively bonded to each other.

6. The vacuum chuck as claimed in claim 1 wherein the porous body has a porosity in the range from 10% to 70%.

7. The vacuum chuck as claimed in claim 1 wherein the porous body has open pores having a pore diameter in the range from 1 μm to 1000 μm.

8. The vacuum chuck as claimed in claim 2 wherein the amount of the thermosetting resin is in the range from 3% to 30% by weight based on the thermoplastic resin.

9. A vacuum chuck which comprises a chuck base and a flat suction head plate having peripheral side surfaces, said head plate being formed from sintered particles of a thermoplastic resin having open pores which serve as the vacuum ducts and wherein the peripheral surfaces have been rendered impermeable to air.

10. The vacuum chuck as claimed in claim 9 wherein the porous body is a sintered powder blend composed of particles of a thermoplastic resin and particles of a thermosetting resin.

11. The vacuum chuck as claimed in claim 9 wherein the thermoplastic resin is a fluorocarbon resin.

12. The vacuum chuck as claimed in claim 9 wherein the thermoplastic resin is a polyamide resin.

13. The vacuum chuck as claimed in claim 9 wherein the chuck base and the suction head are adhesively bonded to each other.

14. The vacuum chuck as claimed in claim 9 wherein the porous body has a porosity in the range from 10% to 70%.

15. The vacuum chuck as claimed in claim 9 wherein the porous body has open pores having a pore diameter in the range from 1 μm to 1000 μm.

16. The vacuum chuck as claimed in claim 10 wherein the amount of the thermosetting resin is in the range from 3% to 30% by weight based on the thermoplastic resin.

17. The vacuum chuck of claim 9 wherein the peripheral surfaces have an adhesive layer thereon thereby rendering the surfaces impermeable to air.

18. The vacuum chuck of claim 9 wherein the peripheral surfaces have a thermoplastic resin layer thereon thereby rendering the surfaces impermeable to air.

19. The vacuum chuck of claim 9 wherein the peripheral surfaces have been heat treated to seal any open pores therein thereby rendering the surfaces impermeable to air.

* * * * *